United States Patent [19]

Reid

[11] Patent Number: 4,598,519

[45] Date of Patent: Jul. 8, 1986

[54] COMPOSITE CONCRETE WALLS HAVING TIE AND FORM SPACER

[76] Inventor: Daniel B. Reid, 72-797 Tampico St., Apt. A, Palm Desert, Calif. 92260

[21] Appl. No.: 630,822

[22] Filed: Sep. 10, 1984

[51] Int. Cl.[4] ..... E04B 2/26

[52] U.S. Cl. ..... 52/426; 52/428; 249/43; 249/216

[58] Field of Search ..... 249/39, 43, 216, 217; 52/425–428

[56] References Cited

U.S. PATENT DOCUMENTS

| | | | |
|---|---|---|---|
| 1,176,255 | 3/1916 | Spaulding | 249/43 |
| 1,617,033 | 2/1927 | Shields | 52/426 |
| 1,767,834 | 6/1930 | Carlson | 249/43 |
| 3,485,003 | 12/1969 | McDowell | 52/426 |
| 3,523,552 | 8/1970 | Ogden | 249/43 |
| 3,652,046 | 3/1972 | Hughes | 249/43 |
| 3,751,867 | 8/1973 | Layne | 52/426 |
| 3,881,291 | 5/1975 | Layne | 52/426 |
| 3,933,332 | 1/1976 | Lovisa et al. | 249/43 |
| 4,079,912 | 3/1978 | Haydock | 249/43 |

FOREIGN PATENT DOCUMENTS

| | | | |
|---|---|---|---|
| 2317207 | 10/1974 | Fed. Rep. of Germany | 52/426 |
| 2522887 | 12/1976 | Fed. Rep. of Germany | 249/43 |
| 184159 | 8/1936 | Switzerland | 249/43 |
| 450687 | 4/1968 | Switzerland | 249/43 |

*Primary Examiner*—Jay H. Woo
*Assistant Examiner*—James Housel
*Attorney, Agent, or Firm*—Selwyn S. Berg

[57] ABSTRACT

A spacer system for concrete forms is described for composite concrete constructions walls which permits the forming materials to remain intact with the concrete poured into the forms. The forming materials then become the exterior surfaces of the mold, saving considerable time and money usually expended in finishing or molding a design into the exterior surfaces.

1 Claim, 6 Drawing Figures

COMPOSITE CONCRETE WALLS HAVING TIE AND FORM SPACER

BACKGROUND OF INVENTION

In the 1930's, there was a surge in the construction of reinforced concrete buildings. An improtant device used in such construction was generally known as a tie rod and spacer rod. The purpose of such a rod was to hold the casting barrier for poured concrete walls setting the thickness of the walls and holding these barriers in place to avoid ballooning. Patentable improvements in the spacer and tie rods considered ease of insertion and removal, versatility, low cost, and cosmetic effects. U.S. Pat. No. 1,907,618 for the form tie of Umback and Diack, issued May 9, 1933, is typical of said tie rods. In all these systems of concrete form molds using such tie rods, the forming hardware, including the forms themselves, were removed, leaving behind the unfaced concrete which had to be worked and then finished with some cosmetically appealing surface.

Modern construction techniques look to simpler systems than the classical tie rods. An objective is a tie rod that may be left on an integral part of the construction and minimizing cosmetic repairs to the finished product. Also, such tie rods should be versatile, easy to install, low cost, and amenable to easy concrete construction techniques. This invention discloses such a tie and form spacer to be used for composite concrete walls so that when the tie rods are removed with associated external hardware, the internal support structure remains within the wall and the facing material remains intact giving a pleasing cosmetic appearance without additional finishing work.

SUMMARY OF INVENTION

A composite concrete wall is one that is molded with the facing sheets intact. As an example, plaster board may be the facing. The tie and form spacer herein described, is composed of two (2) identical plastic caps separated by a plastic tubing and held by a tie. The caps are inserted into each sheet of facing material in some designated array and a pair of sheets are mated with the use of the spacing tube. The mated pair of facing materials are tied together by some bolting means which goes through the center of the caps and sleeve. When the concrete hardens, only the tie rod bolting means is removed.

After the tie rods are removed, and the associated external hardware is disassembled, the facing sheets, in this example, the plaster boards, become the composite finished external surface. Some minor repair is done where the plaster had been penetrated by the tie rods. Other types of sheet material may be used as facing, depending on the cosmetic effect to be achieved. The strength of such facing and the hydrostatic pressure of the pouring determine the thickness of backing required.

PREFERRED EMBODIMENT

Figure 1:
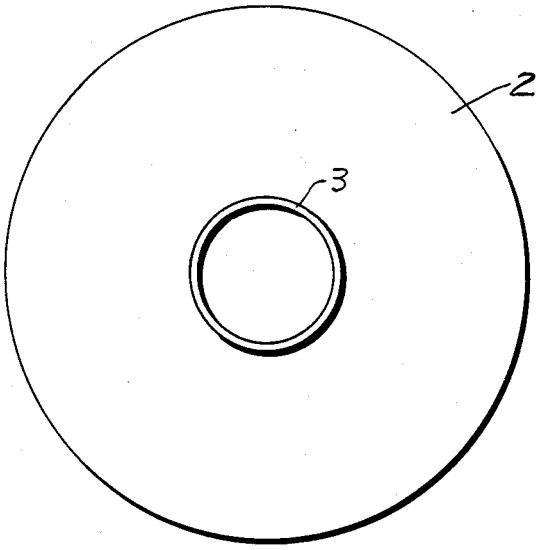
FIGS. 1 and 2 shows two perspectives of a cap.
Figure 2:
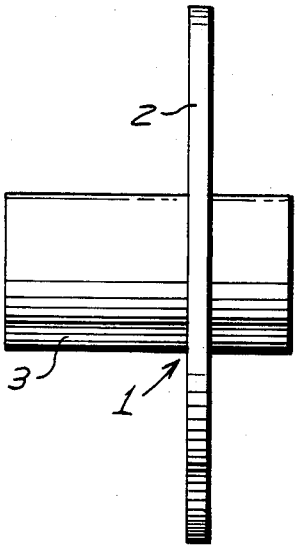

FIGS. 1 and 2 illustrate the cap, 1; comprised of a flange, 2; and barrel, 3. The flange is positioned on a barrel so that a short section of barrel would partially penetrate some facing material and the long section of the barrel would shoulder a sleeve. This short section offset of the barrel is set to insert into the facing material, but not penetrate through.

Figure 3:
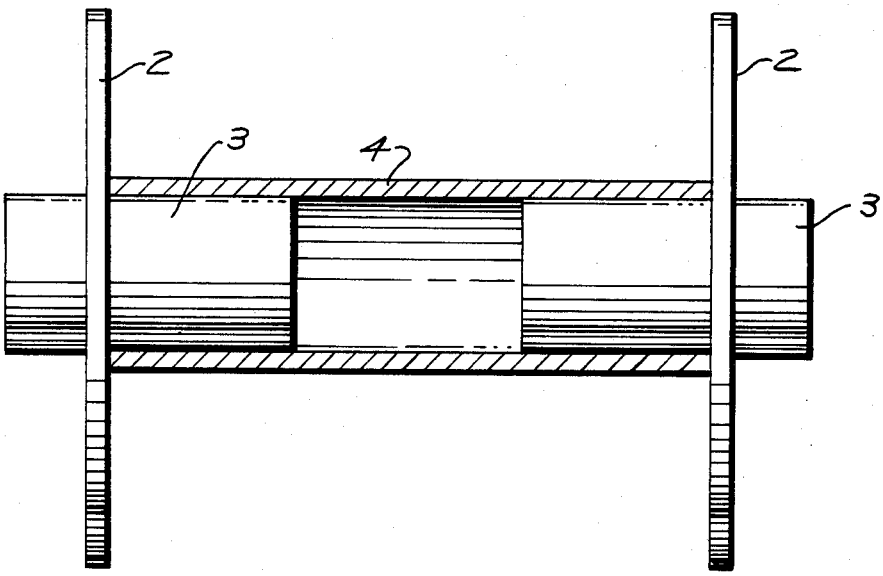
FIG. 3 shows a pair of caps held together by a spacer.

FIG. 3 shows the caps, 1, assembled with a sleeve, 4. Said sleeve is some generic tubular plastic material which may be cut to any length to set the spacing between the flanges, 2.

Figure 4:
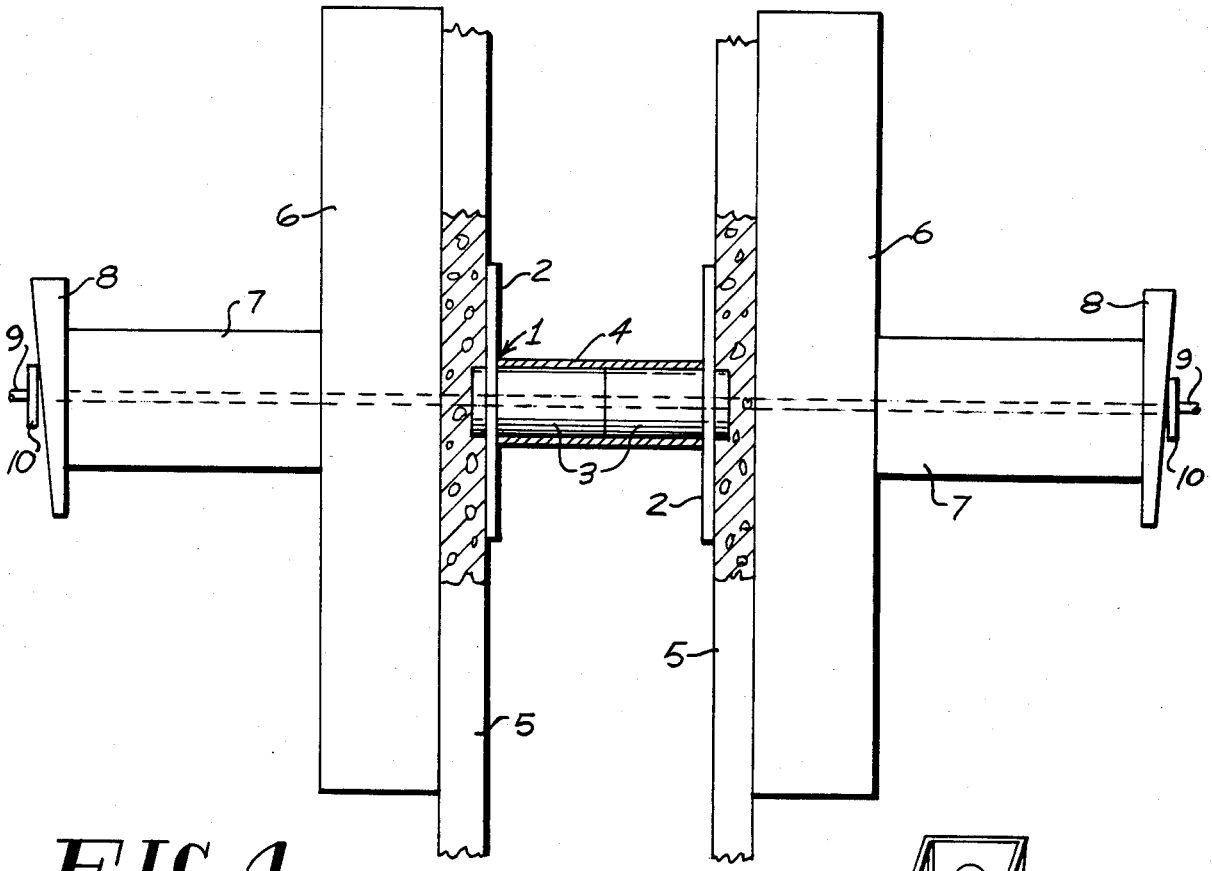
FIG. 4 shows the form spacer assembly tied in place.

FIG. 4 illustrates the use of a simple spacer assembly of FIG. 2 in place between two (2) sheets of facing material, 5. Backing supports, 6, reinforce the facing. Walers, 7, and wedges, 8, may be used in conjunction with the tie, 9, which has some bolting means, 10, to lock the assembly together.

Figure 5:
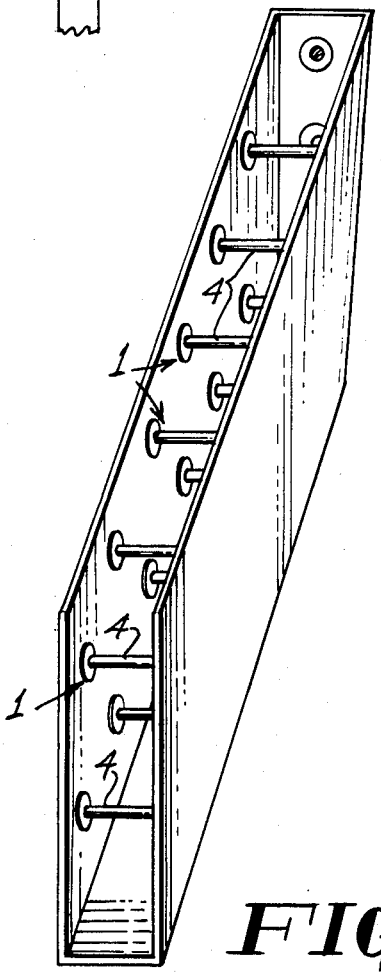
FIG. 5 shows the invention used in a wall.

To illustrate how a wall section may be made, reference is made to FIG. 5. With the use of some type of template, each cap, 1, is located and adhesively or mechanically attached to each section of facing materials, 5. The offset of the barrel (3) is inserted into the back of the facing material, 5, to assure positive positioning while the adhesive sets. Sleeves, 4, are cut, and the two (2) sections of facing materials are mated. Not shown, but implied, backing, 6, walers, 7, wedges, 8, ties, 9, and bolting means, 10, are assembled as needed. The cavity between the facing materials, 5, is now ready for the cement.

Figure 6:
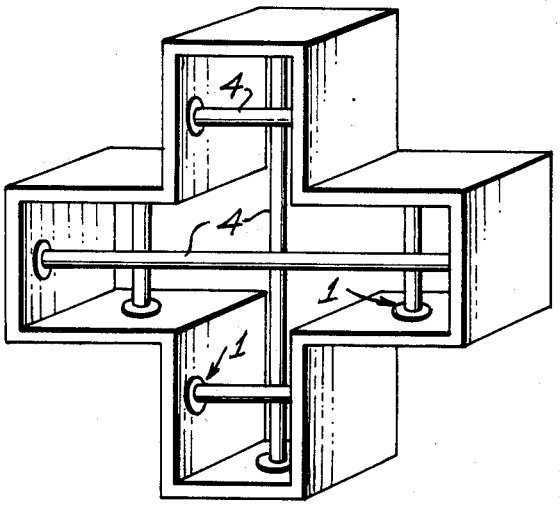
FIG. 6 shows the invention in a cross shaped column.

FIG. 6 shows how sleeves, 4, of various lengths, may be employed with the caps, 1, to create a complex form.

I claim:

1. A composite concrete wall comprised of a concrete filler, a pair of exterior finished facing panels for use in residential housing, and at least one expendable spacer wherein the spacer comprises a pair of caps, a sleeve, and an adhesive, each cap has a flange with a hole cut out and a barrel, the barrel being a short tube having an inner and outer diameter, the diameter of the hole being equal to the outer diameter of the barrel, said barrel extending through the flange such that the flange is longitudinally offset from either end of the barrel, said barrel being firmly attached to said flange, each cap is attached by an adhesive to a finished facing panel such that the barrel extends into the facing panel a distance equal to the distance which the flange is offset from one end of the barrel, said facing panel being the exterior surface of said composite concrete wall and said offset distance of said flange from said one end of the barrel being less than the thickness of said facing panel, with each cap of each pair being attached to a respective facing panel, the caps of each pair being axially aligned, said sleeve being a second tube having a length and an inside diameter with said inside diameter large enough to slide smoothly over the outside diameter of the barrel of each of the axially aligned cap pairs and the length of the tube separating the flanges of the cap pairs and determining the thickness of the concrete filler between the facing panels, whereby said cap pairs with said sleeve are assembled in an array by said adhesive on said facing panels and these panels are rigidly held together by a tie means that does minimum damage to the facing panels so that concrete may be poured into the separation between the facing panels forming a composite concrete wall so that when the tie means are removed a wall has been formed with a finished panel surface which requires only minor repair.

* * * * *